US008225858B2

(12) United States Patent
Martin

(10) Patent No.: US 8,225,858 B2
(45) Date of Patent: Jul. 24, 2012

(54) LUBRICATING WASHPIPE SYSTEM AND METHOD

(76) Inventor: William D. Martin, Spring, TX (US)

( * ) Notice: Subject to any disclaimer, the term of this patent is extended or adjusted under 35 U.S.C. 154(b) by 189 days.

(21) Appl. No.: 12/587,146

(22) Filed: Oct. 2, 2009

(65) Prior Publication Data

US 2010/0101797 A1 Apr. 29, 2010

Related U.S. Application Data

(60) Provisional application No. 61/195,119, filed on Oct. 3, 2008.

(51) Int. Cl.
*E21B 19/00* (2006.01)

(52) U.S. Cl. ..... 166/88.4; 166/84.4; 166/88.1

(58) Field of Classification Search ..... 166/88.4, 166/84.4, 88.1; 251/1.1, 1.2
See application file for complete search history.

(56) References Cited

U.S. PATENT DOCUMENTS

| | | | | |
|---|---|---|---|---|
| 2,608,385 | A | | 8/1952 | Stahl |
| 2,764,428 | A | | 9/1956 | Murphy |
| 3,176,996 | A | | 4/1965 | Barnett |
| 3,353,599 | A | | 11/1967 | Swift |
| 3,364,993 | A | | 1/1968 | Skipper |
| 3,834,715 | A | | 9/1974 | Butler |
| 3,868,832 | A | * | 3/1975 | Biffle ..... 464/163 |
| 3,976,130 | A | | 8/1976 | Chambless |
| 4,143,880 | A | * | 3/1979 | Bunting et al. ..... 277/322 |
| 4,390,063 | A | | 6/1983 | Wells |
| 4,449,596 | A | | 5/1984 | Boyadjieff |
| 4,500,094 | A | * | 2/1985 | Biffle ..... 277/326 |
| 4,552,213 | A | | 11/1985 | Boyd |
| 4,557,489 | A | | 12/1985 | Wentworth |
| 4,574,893 | A | | 3/1986 | Young |
| 5,413,180 | A | | 5/1995 | Ross et al. |
| 6,007,105 | A | | 12/1999 | Dietle |
| 6,016,880 | A | * | 1/2000 | Hall et al. ..... 175/195 |
| 6,145,602 | A | | 11/2000 | Kutinsky |
| 6,527,048 | B1 | | 3/2003 | Trosclair |
| 6,527,049 | B2 | | 3/2003 | Metcalfe |
| 6,725,949 | B2 | | 4/2004 | Seneviratne |
| 6,923,254 | B2 | | 8/2005 | Morrow |
| 7,108,058 | B2 | | 9/2006 | Pippert |
| 2003/0136561 | A1 | | 7/2003 | Metcalfe |
| 2006/0260800 | A1 | * | 11/2006 | Bertane et al. ..... 166/88.1 |
| 2008/0110613 | A1 | | 5/2008 | Holte |

* cited by examiner

*Primary Examiner* — Brad Harcourt
*Assistant Examiner* — Sean Andrish
(74) *Attorney, Agent, or Firm* — Sue Z. Shaper

(57) ABSTRACT

The invention relates to washpipes for use in drilling operations such as drilling for oil and gas, and more particularly to an auto lubricating washpipe and liner system and method.

25 Claims, 4 Drawing Sheets

LUBRICATING WASHPIPE SYSTEM AND METHOD

CROSS REFERENCE TO RELATED APPLICATIONS

This application is related to and claims priority to provisional Application Ser. No. 61/195,119, filed Oct. 3, 2008, inventor William David Martin, entitled Auto Lubricating Washpipe System and Method, which application is hereby incorporated by reference herein in its entirety.

FIELD OF THE INVENTION

The invention relates to washpipes used in drilling operations, such as in operations drilling for oil and gas, and more particularly to an auto lubricating system and method of use with such washpipes.

BACKGROUND OF THE INVENTION

Oil and gas drilling rigs frequently support a rotating drill pipe with a swivel or top drive anchored to a derrick. The swivel or top drive provides support for the rotating pipe and provides a sealed joint between fixed portions of the rig and rotating portions of the pipe. The top drive or swivel may include a suspended gear box that allows drill pipe extending out the bottom of the swivel to be rotated. Alternately a kelly drive and rotary table may be used.

Drilling fluid, such as mud or air, passes through a top portion of the swivel, referred to as a "gooseneck," and down through the rotating pipe. With such swivel or top drive, the fluid or air passes through a tube, referred to as a "washpipe," that sealingly mates with a portion of the rotating drill pipe at a seal or packing assembly. Either the seal or the washpipe rotates with the pipe; the other remains stationary.

A swivel is typically anchored to a derrick frame so that the swivel's motion itself is limited to the vertical direction. A power swivel typically carries a motor for turning the drill pipe and mates with the gooseneck or hose or line for communicating drilling fluid from a fluid reservoir to the open top end of the rotating drill pipe. The drilling fluid may be under pressures up to 5,000 to 7,000 psi and temperatures up to 200 degrees Fahrenheit as it flows from the gooseneck through the swivel or top drive containing the washpipe and to the drilling pipe suspended for rotation.

To provide sealing mating between fixed swivel portions and rotating drill pipe, while pumping drilling fluid down the rotating drill pipe, the drilling fluid potentially under high temperature and pressure, the swivel carries a carefully machined washpipe and packing assembly. Typically the washpipe is stationary with the top of the washpipe sealingly connecting, directly or indirectly, with the bottom of the gooseneck and the bottom of the stationary washpipe sealingly connecting, via a rotating packing assembly, to rotating drill pipe. The rotating packing assembly provides a rotating seal SL, FIG. 1, for mating with a smoothly coated surface of a stationary washpipe. The rotating seal SL, FIG. 1, typically comprises a series of vertically stacked packing ring seals (made of a pliable material) which rotate about the circumference of the stationary washpipe tube, maintaining a fluid tight seal even under high pressure and temperature conditions.

To maintain the rotating seal under the high pressures and temperatures demanded in some operations with drilling fluids, the packing assembly must be frequently lubricated. Although the washpipe is structured (milled, ground, coated) for sealing with a rotating packing assembly at its lower end, sufficient friction is generated, taking into account that the joint must continue to seal against high pressure and temperature, that the packing assembly must be lubricated several times a day.

Typically a packing assembly is lubricated at least twice a day. The purpose of adding lubricant media to the packing rings can be twofold, to "energize" the packing rings to insure that a seal lip continues to stay in contact with the washpipe tube and to provide a boundary lubricant film between the seal lip and the washpipe tube to reduce friction and thereby increase seal effectiveness and life cycle. Lubricating a packing assembly in normal conditions requires stopping the rotating operation at set time intervals so that the lubricant can be injected at the packing assembly lubrication point. Current art techniques for lubrication require the drilling to be suspended and the packing assembly to be held stationary for 15 to 30 minutes while the lubricant is manually inserted through a portion of the outer wall of the packing assembly. This requires at least one person to ascend the derrick. Harsh conditions (high rotational and extreme high pressure) may require an even shortened service interval due to elevated friction between the seal lips and the washpipe.

The standard lubrication operation typically requires the efforts of three men, one of whom is required to climb the derrick. Such operations involve a certain amount of risk for the personnel as well as downtime.

The objective in developing the instant "sleeved" washpipe is to address at least one of three major goals: 1) reduce the hazard and risk to personnel by eliminating a need for frequent manual maintenance of the seal lubrication; 2) increase the life cycle of the washpipe and seals by providing a better thermal and pressure protection to the washpipe tube via added wall thickness (the internal sleeve) and precise lubrication at exact intervals as dictated by the end user via an adjustable control system; and 3) save the end user time and money by eliminating the need to stop operations for periodic maintenance of the washpipe stuffing box seals.

Preferred embodiments of the instant invention provide for ports in the washpipe, at least one port communicating through the washpipe at an exterior portion of the washpipe outside of the packing assembly/washpipe interface area and at least one other port communicating through the washpipe tube within the packing assembly/washpipe interface area. The invention further preferably provides a communication channel, at least in part by cooperation with a washpipe liner, such that lubricant can be inserted into at least one first port and transmitted to at least one second port, and thence to a packing assembly/washpipe interface area, preferably semi or fully automatically, without a human having to climb a derrick. Potentially, lubrication can be performed while drilling.

Preferably, the communication channel is provided by means of a channel in or between an exterior portion of a sleeve preferably having an interference fit with the interior of the washpipe and an interior portion of the washpipe. The channel should register for fluid communication with the washpipe ports. The channel could be accommodated by altering portions of the washpipe.

Preferably, the sleeve is comprised of a plastic that has characteristics of (1) toughness under high temperature and pressure; (2) resistance to erosion and cracking from drilling fluid, and (3) a capacity to shrink when cooled and re-expand at ambient temperature in order to maintain a high temperature, high pressure seal so as to neither leak nor be eroded nor be cracked by abrasion from the drilling fluid. The interior sleeve could be comprised of a stainless steel for some embodiments and pressure/temperature ranges.

SUMMARY OF THE INVENTION

The instant invention operates with a washpipe that is held stationary while a mating packer assembly rotates with drill pipe.

The instant invention includes a lubricating washpipe and liner combination, or system comprising a washpipe having a contact region for sealingly mating with a rotating packing assembly and having another region outside of the first region.

The invention preferably includes a washpipe liner comprising a sleeve structured for an interference fit within the washpipe, preferably via thermal shrinkage and expansion, and wherein the sleeve provides, at least a part of, a channel, structured in combination with the washpipe, to provide for lubricant communication between washpipe ports.

The ports for the washpipe need not be of any particular size or shape or length. The ports must simply function to provide a channel for lubricant communication through the washpipe. Likewise the conduit for lubricant communication between a first port and a second port could be of various sizes, shapes and lengths. In combination, a first port, a conduit and a second port provide lubricant communication from outside the washpipe to the region between the washpipe and the rotating packing assembly. The size and shape of the conduit and the ports, and the number of the conduits and the ports can take into account a variety of considerations, including the nature of the lubricant and its viscosity and the size of the washpipe.

The invention also includes a method for lubricating a washpipe comprising preferably interference fitting a liner to interior portions of a washpipe, preferably via thermal shrinkage and expansion, such that in combination, a communication channel defined at least in part by the liner provides lubricant communication between a first washpipe port, communicating with a portion of the washpipe structured for sealingly mating with a packing assembly, and a second washpipe port outside of that region.

BRIEF DESCRIPTION OF THE DRAWINGS

A better understanding of the present invention can be obtained when the following detailed description of the preferred embodiments are considered in conjunction with the following drawings, in which.

The drawings are primarily illustrative. It would be understood that structure may have been simplified and details omitted in order to convey certain aspects of the invention. Scale may be sacrificed to clarity.

DETAIL DESCRIPTION OF THE PREFERRED EMBODIMENTS

Figure 1:
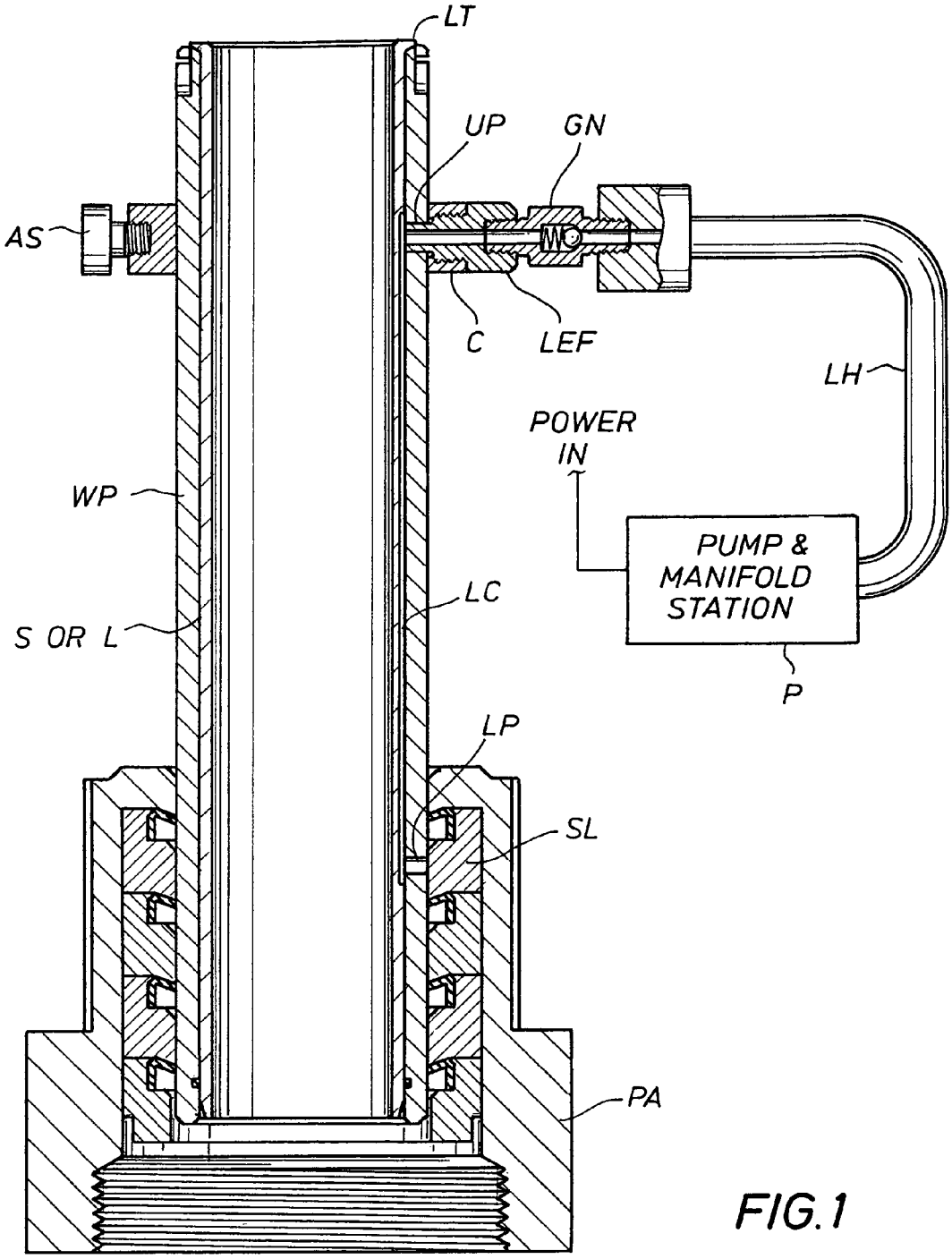
FIG. 1 illustrates a cut-away drawing of a preferred embodiment of a washpipe with an interference fit sleeve or liner of the instant invention, in cross-section, wherein a channel in the sleeve and between the sleeve and washpipe communicates between an upper washpipe port and a lower washpipe port.

A preferred embodiment of a washpipe sleeve for a lubricating washpipe assembly is illustrated in FIG. 1 and includes of two major components, an internal interference fit sleeve or liner S or L with a lube channel LC machined on an external side of the sleeve tube S and a lube collar C structured to mount on an external portion of a washpipe tube WP. The washpipe itself contains appropriate ports LP, UP drilled or formed to assist the lubrication function.

The sleeve is preferably machined internally and externally to specific dimensions depending on the size of the washpipe to be sleeved. A lubrication channel LC is machined into an external wall of the sleeve, starting at an area toward a first end that would, preferably, correspond to an area just below the upper retainer nut RN, see FIGS. 3 and 4, of the washpipe tube, and continue to a second end of the sleeve to a position that would correspond to the washpipe/packing assembly PA interface area.

Materials used for preferred embodiments of the sleeve are preferably of two types: a) polyetheretherketone (PEEK) (a thermal plastic) useful for extreme high heat, high friction fluid/air circulating systems and b) a 17.4 ph stainless steel for normal fluid/air circulating systems.

The sleeve is preferably retained internally to the washpipe tube via a lipped top LT on the sleeve and an interference fit. A conventional washpipe could be used, assuming that the washpipe is ported at specified areas LP, UP to intersect with lubricant channel LC. Only one lubricant channel may be required to achieve the desired results; however, for larger diameter stuffing boxes and washpipes, or for other reasons, a plurality of lube channels and/or ports may best accommodate lubricant needs.

A lube collar C, in one embodiment, is preferably affixed to an upper external portion of the washpipe, preferably just below a washpipe retainer nut RN. The construction of the collar would be preferably of a 17.4 ph stainless steel. Preferably the collar would be bored through in two places to accommodate: a) a lubricant entry port fitting LEF and b) a sensor AS which could detect flow or no flow, and which could best enable a lubricant pump P to be automatically activated for a total automation of the "system."

A lubricant entry port fitting LEF preferably inserts through the collar C and into an uppermost drilled port UP of the washpipe. An "o" ringed shoulder can limit the travel of a lubricating port GN (e.g. grease nipple) into the intersecting hole to insure exact clearance between the nipple and the internal lubricant channel LC. The fitting preferably has a threaded body which screws into the lube collar C for retention. A standard lubricating port GN (e.g. grease nipple) can be threaded into the lube entry port fitting LEF, for conventional lubricating, or a hose LH attached to an automatic lubricating device, such as a single point auto lubricating device, could be inserted.

An acoustical sensor/accelerometer AS attached to the collar C could detect flow or no flow of lubricant by sensing vibration coming through the collar, which could then be used to assist an automated lubricant system to activate/deactivate a lubricant pump P.

In an alternate embodiment, the upper port UP could be a threaded port in the washpipe, to which the lubricant entry port fitting LEF would attach directly, such that a separate lube collar would not be required. Another embodiment could include boring a threaded port into the retainer nut RN, the threaded port in the retainer nut RN being aligned with the upper port UP of the washpipe. O-rings would be used with the alternate embodiments to ensure exact clearance between the nipple and the internal lubricant channel as described above.

In a further alternate embodiment, one or more cooling channels CC could be machined on an external side of the sleeve tube S in addition to one or more lube channels LC. The washpipe itself must have appropriate cooling ports, UCP drilled or formed, such that the cooling channel(s) would correspond to and align with the cooling ports. A coolant entry point fitting CEF would preferably insert into the upper most cooling port UCP, through which cooling fluids could be injected. It is believed that the operating temperature of the washpipe itself could be lowered to approximately 90° F. from what is believed to be a non-cooled operating range of 250°-300° F.

Figure 2:
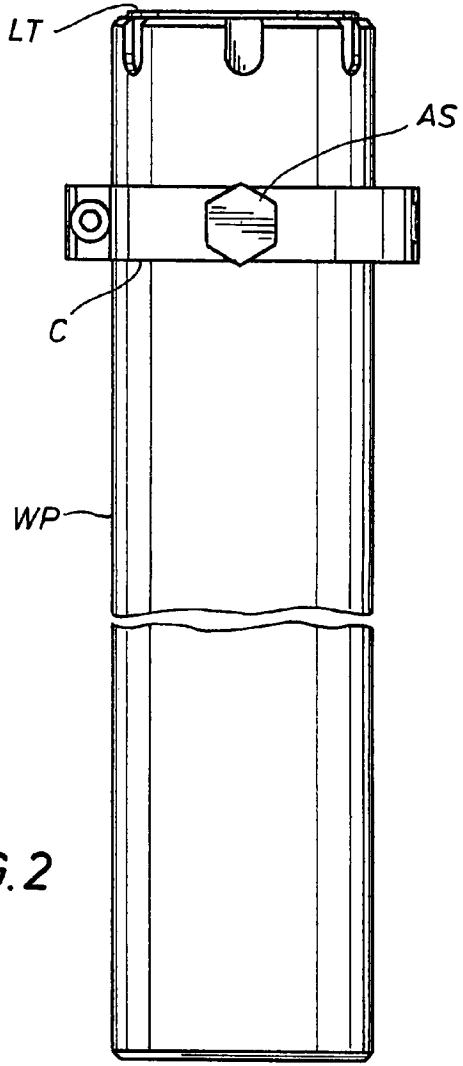
FIG. 2 illustrates a side view of a preferred washpipe and lube collar embodiment.
Figure 5:
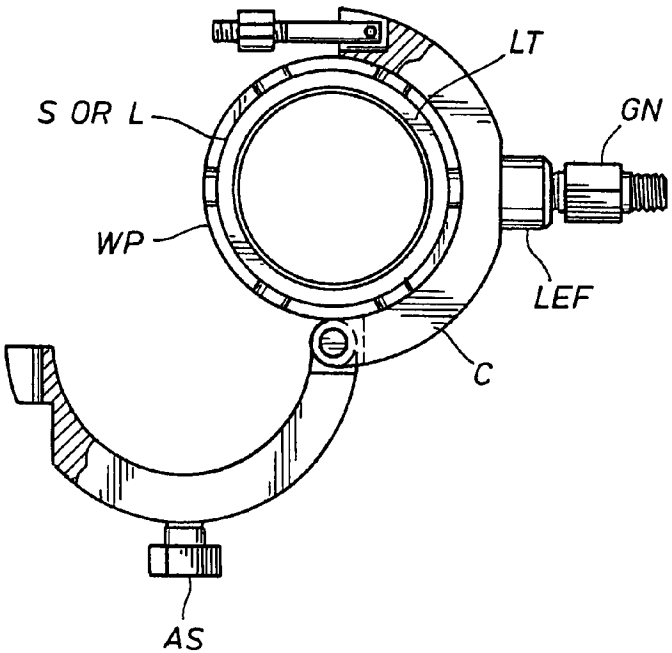
FIG. 5 illustrates a top view of a preferred washpipe and lube collar embodiment, wherein a lube collar is illustrated as a two-piece hinged device to facilitate delivery of the lubricant to the system.
Figure 3:
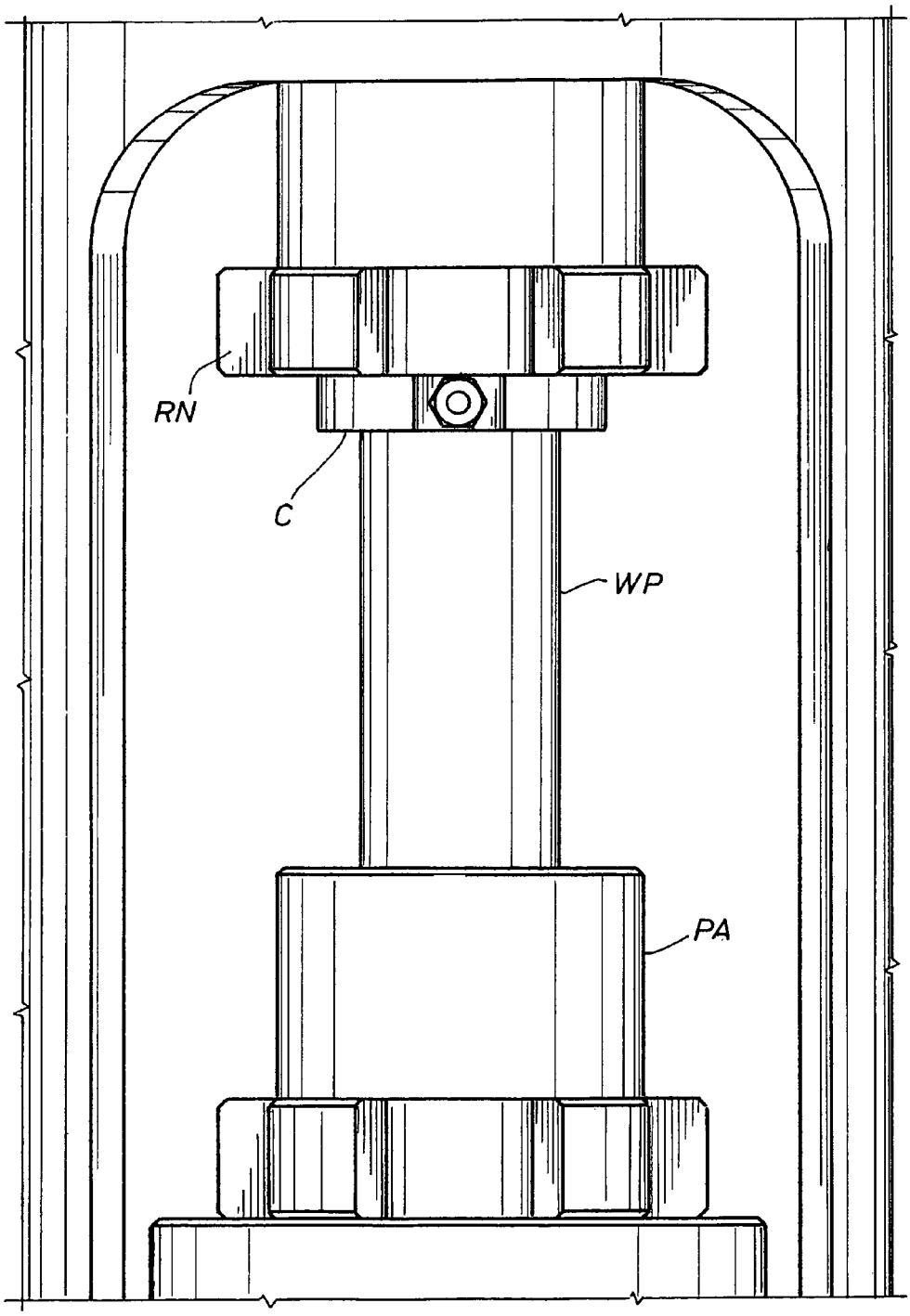
FIG. 3 illustrates the above washpipe and lube collar installed in a swivel.
Figure 4:
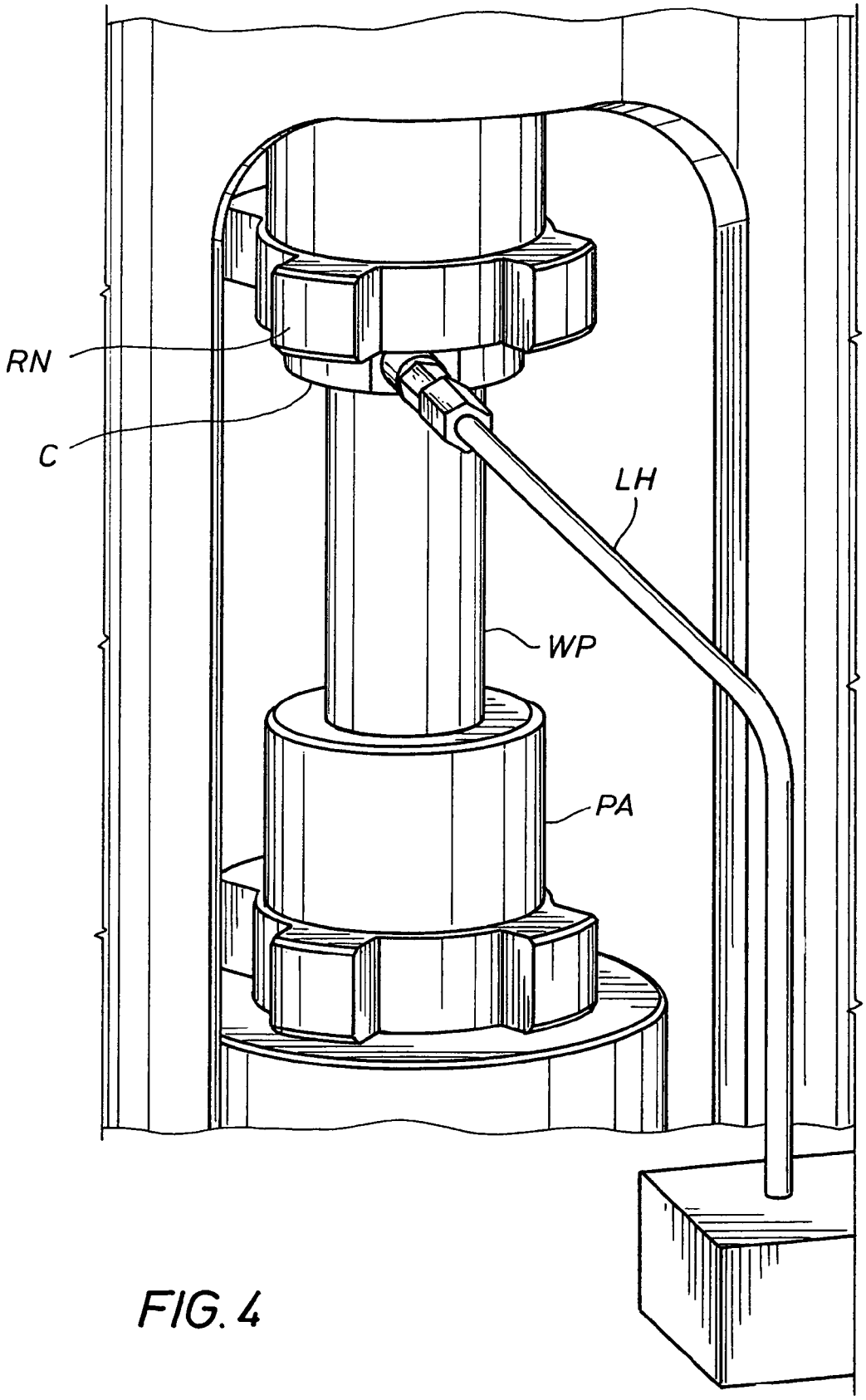
FIG. 4 illustrates the washpipe and lube collar above installed in the swivel with a lube fitting and hose attached to a source of lubricant.

FIG. 2 shows a preferred embodiment of a washpipe WP fitted with a hinged lubricant collar C (to which an acoustical sensor AS is shown affixed) and an internal interference fit sleeve. The preferred embodiment of FIG. 2 is shown in FIGS. 3 and 4 installed in a swivel. The upper portion of the washpipe WP is held stationary by a retainer nut RN, and the lower portion extends down into a rotatable packing assembly PA. A hinged collar C is affixed to the upper portion of the washpipe at a point just below the retainer nut RN. A lubricating port GN is shown inserted into the lubricant entry port fitting LEF of the collar C. FIG. 4 further shows a lubricant hose LH attached to the lubricating port GN.

A field test was conducted on a 1500 Hp. Inland drilling barge, beginning Jul. 4, 2008 and halted Jul. 31, 2008. A total of 5000' of hole and 120 hours rotating time with a pump pressure averaging 1500 psi was achieved. A thorough analysis of the washpipe sleeve indicated no adverse wear whatsoever.

The first stage of the well was completed to surface casing depth with no issues whatsoever. The rig was pulled out of the hole to run casing and then returned to drilling. A significant concern for the proper operation of the auto lubrication system was during the surface hole phase, due to extreme vibration and acceleration forces from the top drive coupled with poor drilling fluid quality with high solids content. That concern was alleviated. Conditions are less harsh for the washpipe and lube system after the surface hole phase.

Two of the three objectives of the test were met with exceedingly high marks, as agreed by the end user. The exception was increased life span of the packing seals. The packing seals failed in an unanticipatedly short time due to lack of lubrication. A failure analysis revealed, however, a broken lubricant supply line at the lubricating pump, which inadvertently occurred early on without notice. A fitting was broken when workers made a repair to a completely unrelated device near the lubricating pump. This went unreported and unrepaired until the failure of the packing seals. Such was the cause of the lack of lubrication, not a failure in the design of the system.

Unanticipated Findings:

Even so, even though the packing seals failed early due to an unrelated broken lube fittings, this failure occurred after more than 72 hours of operation with the lubricant supply line broken. The normal lubricating interval is every 8 hours. The conclusion was that the seals survived so long without any lubrication due to the quantity of lubrication supplied prior to the line breaking, sufficient to sustain the seals by a factor of eight. One could extrapolate and predict from this factor of eight a significant increase of normal seal life. It was also noted that the lubricant amount supplied through the sleeve to the packing rings was approximately 100 times greater than that supplied using existing maintenance practices. The instant system allowed for this lubricating to be done automatically, with no downtime.

A further interesting discovery was that a vortex effect is created from the fluid exiting the washpipe and sleeve below the packing seals, in effect creating a suction effect of unknown proportion on the packing seals. This was evidenced during the root cause analysis of the packing ring failure. Having fortuitously gleamed this fact, it would now be possible to further design a specific set of seal rings with centrifugal ribs on the energized side of the seal rings, coupled with an opposing smooth seal ring lower mate. This further innovation, including an inverted normal packing seal, could negate the suction force while the opposing "ribbed" seal acts to siphon lubricant into the cavity. This further innovation theoretically could negate a need for forced lubrication at least over long periods of time, a feature possible when using the sleeved washpipe with lubricant channel, as described above.

The original lube collar was a two piece assembly affixed to the washpipe with cap screws. This was determined to be inconvenient and somewhat time consuming to install during the test. A revision of the design is complete which does nothing to the integrity of the lube entry point and sensor point areas but allows for a hinge and hinge bolt retainer to minimize installation and disassembly time.

Personnel involved with the field testing from the field to the management halls, are excited and eagerly anticipate the return and further testing of the new system. A substantial order from the field test customer is already anticipated.

The foregoing description of preferred embodiments of the invention is presented for purposes of illustration and description, and is not intended to be exhaustive or to limit the invention to the precise form or embodiment disclosed. The description was selected to best explain the principles of the invention and their practical application to enable others skilled in the art to best utilize the invention in various embodiments. Various modifications as are best suited to the particular use are contemplated. It is intended that the scope of the invention is not to be limited by the specification, but to be defined by the claims set forth below. Since the foregoing disclosure and description of the invention are illustrative and explanatory thereof, various changes in the size, shape, and materials, as well as in the details of the illustrated device may be made without departing from the spirit of the invention. The invention is claimed using terminology that depends upon a historic presumption that recitation of a single element covers one or more, and recitation of two elements covers two or more, and the like. Also, the drawings and illustration herein have not necessarily been produced to scale.

What is claimed is:

1. A lubricating washpipe system, comprising:

a washpipe having a first exterior portion for sealing mating with a rotating packing assembly with a first port communicating with the first portion, and having a second port through the washpipe providing communicating through the washpipe outside of said first portion; and a liner structured and sized to attach within the washpipe;

said liner and washpipe structured in combination to provide a conduit within the washpipe and linear combination for lubricant communication between said first port and said second port, said liner defining said conduit at least in part.

2. The system of claim 1 wherein the washpipe liner includes a sleeve structured for interference fit with the washpipe.

3. The system of claim 1 wherein the conduit for lubricant communication includes at least one of a channel on an outer surface of the liner and a channel on an inner surface of the washpipe.

4. The system of claim 1 wherein the washpipe liner includes a thermally shrinking and expanding material.

5. The system of claim 1 wherein the liner includes polyether ether ketone (PEEK) material.

6. The system of claim 1 wherein the liner includes stainless steel material.

7. The system of claim 1 that includes a collar structured to attach to the washpipe, having an interior communication groove for communicating lubricant with said second port and having a fitting for fluid communication with a lubrication source.

8. The system of claim 7 wherein the collar includes a hinged collar, structured for attachment to an exterior portion of a washpipe.

9. The system of claim 4 wherein the thermal shrinking and expanding material includes material shrinking upon contact with liquid nitrogen.

10. A washpipe liner, comprising:

a sleeve structured and sized for an interference fit with interior regions of a washpipe, including regions interior of an exterior contact region of the washpipe structured for sealing mating with a packing assembly, and;

the sleeve defining at least in part a channel, structured in combination with the washpipe, for lubricant communication over a portion of a length of the sleeve.

11. The liner of claim 10 structured of polyether ether ketone (PEEK).

12. The liner of claim 10 structured of stainless steel.

13. The liner of claim 10 wherein the sleeve comprises material providing thermal shrinkage and expansion.

14. The liner of claim 13 wherein the thermal shrinkage includes by contact with liquid nitrogen.

15. A method for lubricating washpipe, comprising;

interference fitting a liner to interior portions of a washpipe defining at least, in combination, a communication channel providing lubricant communication between a first washpipe port communicating with an exterior portion of a first washpipe region structured for sealing mating with a packing assembly, and a second washpipe port outside of the first region.

16. The method of claim 15 wherein the interference fitting includes by thermally shrinking and expanding.

17. The method of claim 15 that includes structuring a liner communication channel, at least in part, on an outer surface of the liner.

18. The method of claim 16 wherein the thermally shrinking includes contacting with liquid nitrogen.

19. The method of claim 15 that includes attaching a collar around the washpipe wherein the collar includes an interior communication groove for communicating lubricant and a fitting for communication with a lubricant source.

20. The lubricating washpipe system of claim 1 wherein the liner is structured to attach within the washpipe between the first port and the second port.

21. The lubricating washpipe system of claim 1 including the liner sized and structured to attach substantially within the washpipe.

22. The washpipe liner of claim 10 including the sleeve sized and structured for an interference fit substantially within interior regions of the washpipe.

23. The washpipe liner of claim 10 including the sleeve sized and structured for an interference fit within interior regions of the washpipe.

24. The washpipe system of claim 1 wherein the liner includes 17-4 ph stainless steel.

25. The washpipe liner of claim 10 wherein the liner includes 17-4 ph stainless steel.

* * * * *